US010954117B2

(12) United States Patent
Shock et al.

(10) Patent No.: US 10,954,117 B2
(45) Date of Patent: Mar. 23, 2021

(54) MOBILE DISTRIBUTION STATION HAVING PNEUMATIC VALVES

(71) Applicant: United Technologies Corporation, Farmington, CT (US)

(72) Inventors: Ricky Dean Shock, Victoria, TX (US); Michael Webber, Austin, TX (US)

(73) Assignee: FUEL AUTOMATION STATION, LLC., Birmingham, MI (US)

( * ) Notice: Subject to any disclaimer, the term of this patent is extended or adjusted under 35 U.S.C. 154(b) by 0 days.

(21) Appl. No.: 16/535,510

(22) Filed: Aug. 8, 2019

(65) Prior Publication Data

US 2020/0062580 A1 Feb. 27, 2020

Related U.S. Application Data

(60) Provisional application No. 62/722,271, filed on Aug. 24, 2018.

(51) Int. Cl.

| | |
|---|---|
| ***B67D 7/04*** | (2010.01) |
| ***B67D 7/36*** | (2010.01) |
| ***B67D 7/78*** | (2010.01) |
| *E21B 43/26* | (2006.01) |
| *B67D 7/84* | (2010.01) |
| *B67D 7/62* | (2010.01) |
| *B67D 7/40* | (2010.01) |

(52) U.S. Cl.

CPC ..... *B67D 7/36* (2013.01); *B67D 7/04* (2013.01); *B67D 7/78* (2013.01); *B67D 7/40* (2013.01); *B67D 7/62* (2013.01); *B67D 7/845* (2013.01); *E21B 43/26* (2013.01)

(58) Field of Classification Search

CPC ... B67D 7/36; B67D 7/78; B67D 7/04; B67D 7/845; B67D 7/62; B67D 7/40; E21B 43/26

See application file for complete search history.

(56) References Cited

U.S. PATENT DOCUMENTS

| | | | | |
|---|---|---|---|---|
| 7,628,182 | B2 * | 12/2009 | Poulter | B67D 7/36 137/263 |
| 8,905,089 | B2 * | 12/2014 | Evans | G05D 7/0617 141/231 |
| 9,586,805 | B1 * | 3/2017 | Shock | B67D 7/845 |
| 9,790,080 | B1 * | 10/2017 | Shock | B67D 7/3272 |
| 9,932,220 | B1 * | 4/2018 | Shock | B67D 7/40 |
| 9,981,840 | B2 * | 5/2018 | Shock | B67D 7/465 |
| 10,087,065 | B2 * | 10/2018 | Shock | B67D 7/845 |
| 10,150,662 | B1 * | 12/2018 | Shock | B67D 7/84 |
| 10,289,126 | B2 * | 5/2019 | Shock | G01S 7/003 |
| 10,303,190 | B2 * | 5/2019 | Shock | G05D 9/12 |

(Continued)

*Primary Examiner* — Nicolas A Arnett

(74) *Attorney, Agent, or Firm* — Carlson, Gaskey & Olds, P.C.

(57) ABSTRACT

A distribution station includes a plurality of pneumatic valves on a mobile structure. Each pneumatic valve is situated between a manifold and a reel of a plurality of reels. A plurality of secondary valves are connected by an air or gas line to corresponding ones of the pneumatic valves. Each secondary valve is operable between open and closed positions to permit air or gas flow to the corresponding pneumatic valve to open and close the pneumatic valve. A controller is configured to individually open and close the secondary valves responsive to fluid level sensors.

9 Claims, 4 Drawing Sheets

(56) References Cited

U.S. PATENT DOCUMENTS

| | | | | |
|---|---|---|---|---|
| 10,494,251 | B2 * | 12/2019 | Shock | B67D 7/845 |
| 10,513,426 | B2 * | 12/2019 | Shock | B67D 7/3272 |
| 10,633,243 | B2 * | 4/2020 | Shock | B65H 75/4402 |
| 2017/0276293 | A1 * | 9/2017 | McKim | F16N 21/00 |
| 2018/0209257 | A1 * | 7/2018 | Bobadilla Larios | E21B 43/26 |
| 2019/0119096 | A1 * | 4/2019 | Haile | B67D 7/303 |
| 2019/0324010 | A1 * | 10/2019 | Allouche | E21B 34/16 |
| 2020/0141233 | A1 * | 5/2020 | Allouche | H04W 4/38 |

* cited by examiner

MOBILE DISTRIBUTION STATION HAVING PNEUMATIC VALVES

CROSS-REFERENCE TO RELATED APPLICATION

This application claims priority to U.S. Provisional Application No. 62/722,271 filed Aug. 24, 2018.

BACKGROUND

Hydraulic fracturing (also known as fracking) is a well-stimulation process that utilizes pressurized liquids to fracture rock formations. Pumps and other equipment used for hydraulic fracturing typically operate at the surface of the well site. The equipment may operate until refueling is needed, at which time the equipment may be shut-down for refueling. Shut-downs are costly and reduce efficiency. More preferably, to avoid shut-downs fuel is replenished in a hot-refueling operation while the equipment continues to run. However, hot-refueling can be difficult to reliably sustain for the duration of the fracking operation. This invention enables hot-refueling so fracking operations to proceed continuously for longer durations, which can increase well productivity, improve safety, and reduce costs.

SUMMARY

A distribution station according to an example of the present disclosure includes a plurality of pneumatic valves on a mobile structure. Each of the pneumatic valves is situated between a manifold and a reel of a plurality of reels. A plurality of secondary valves are connected by an air or gas line to a corresponding one of the pneumatic valves. Each of the secondary valves are operable between open and closed positions to permit air or gas flow to the corresponding pneumatic valve to open and close the pneumatic valve. A controller is configured to individually open and close the secondary valves responsive to fluid level sensors.

A further embodiment of any of the foregoing embodiments includes a pressurized gas source connected to the pneumatic valves.

In a further embodiment of any of the foregoing embodiments, the pressurized gas source includes a compressor.

In a further embodiment of any of the foregoing embodiments, the pressurized gas source includes a pressurized gas manifold.

In a further embodiment of any of the foregoing embodiments, the mobile structure includes first and second compartments separated by a wall. The controller is located in the second compartment.

A further embodiment of any of the foregoing embodiments includes a pressurized gas source connected to the pneumatic valves.

In a further embodiment of any of the foregoing embodiments, the pressurized gas source includes a pressurized gas manifold located in the first compartment.

A distribution station according to an example of the present disclosure includes a pump, a manifold connected with the pump, and a plurality of hoses. Each hose is connected by a fluid passage to the manifold. Pneumatic valves are situated between the manifold and hoses and are operable to control fluid flow through the fluid passages. A plurality of fluid level sensors are associated with different ones of the hoses. A plurality of secondary valves are connected by an air or gas line to the pneumatic valves. Each of the secondary valves is operable between open and closed positions to permit air or gas flow to the corresponding pneumatic valve to open and close the pneumatic valve. A controller is configured to individually open and close the secondary valves responsive to the fluid level sensors.

A further embodiment of any of the foregoing embodiments includes a pressurized gas source connected to the pneumatic valves.

In a further embodiment of any of the foregoing embodiments, the pressurized gas source includes a compressor.

In a further embodiment of any of the foregoing embodiments, the pressurized gas source includes a pressurized gas manifold.

In a further embodiment of any of the foregoing embodiments, the mobile structure includes first and second compartments separated by a wall. The pneumatic valves and the secondary valves are located in the first compartment.

In a further embodiment of any of the foregoing embodiments, the controller is located in the second compartment.

A further embodiment of any of the foregoing embodiments includes a pressurized gas source connected to the pneumatic valves.

In a further embodiment of any of the foregoing embodiments, the pressurized gas source includes a pressurized gas manifold located in the first compartment.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
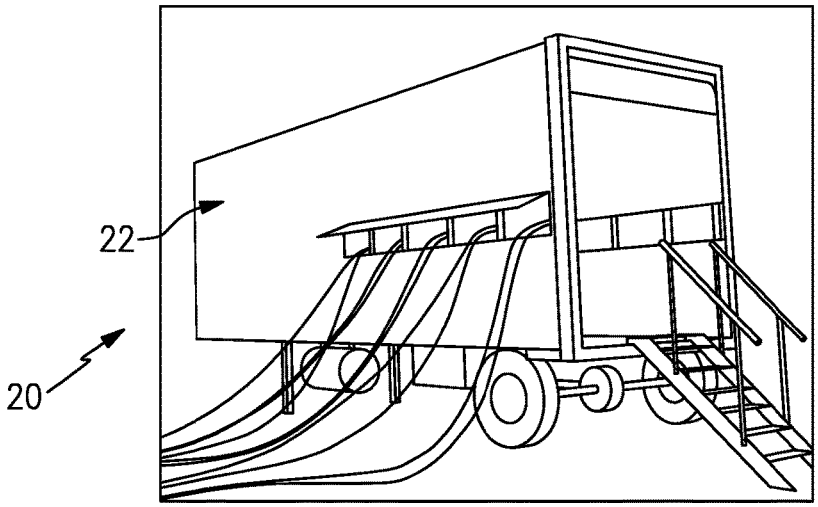
FIG. 1 illustrates an example mobile distribution station.
Figure 2:
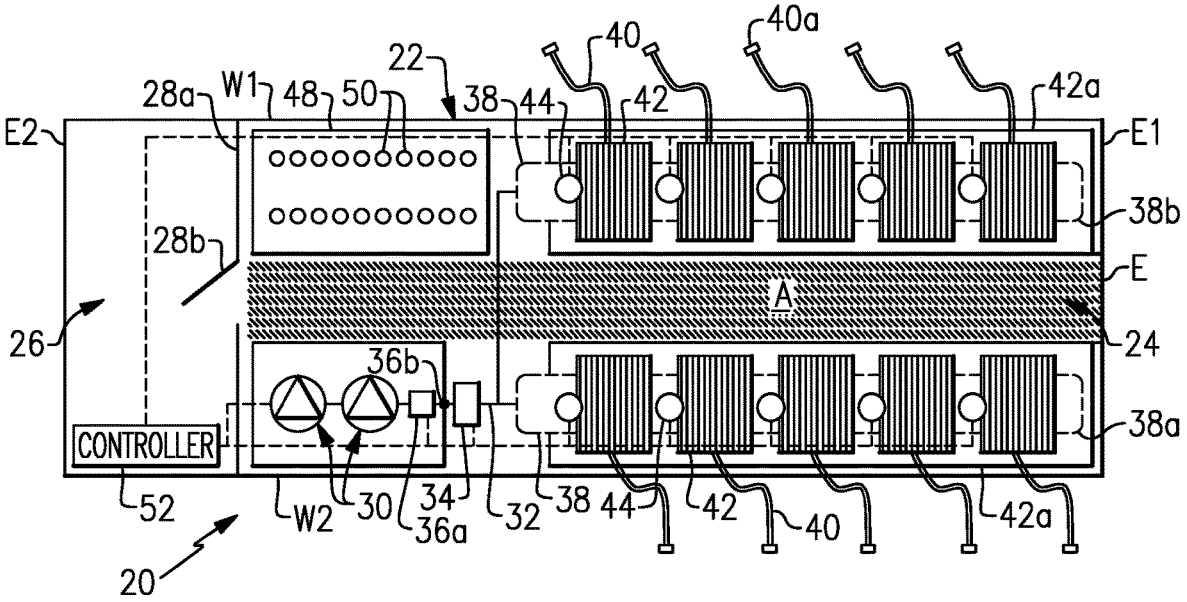
FIG. 2 illustrates an internal layout of a mobile distribution station.

FIG. 1 illustrates a mobile distribution station 20 and FIG. 2 illustrates an internal layout of the station 20. As will be described, the station 20 may serve in a "hot-refueling" capacity to distribute fuel to multiple pieces of equipment or units, such as but not limited to, fracking equipment at a well site. As will be appreciated, the station 20 is not limited to applications for fracking or for delivering fuel. The examples herein may be presented with respect to fuel delivery, but the station 20 may be used in mobile delivery of other fluids, in other gas/petroleum recovery operations, or in other operations where mobile refueling or fluid delivery will be of benefit.

In this example, the station 20 includes a mobile container, structure, or trailer 22 (but will collectively be referred to as "mobile trailer"). In this example, the mobile trailer 22 is elongated and has first and second opposed trailer side walls W1 and W2 that join first and second opposed trailer end walls E1 and E2. Most typically, the trailer 22 will also have a closed top (not shown). The mobile trailer 22 may have wheels that permit the mobile trailer 22 to be moved by a vehicle from site to site to service different hot-refueling operations, but the trailer 22 is not limited to wheeled configurations and may alternatively be a skid, container, or other structure. In this example, the mobile trailer 22 has two compartments. A first compartment 24 includes the physical components for distributing fuel, such as diesel fuel, and a second compartment 26 serves as an isolated control room for managing and monitoring fuel distribution. The compartments 24/26 are separated by an inside wall 28*a* that has an inside door 28*b*.

The first compartment 24 includes one or more pumps 30. Fuel may be provided to the one or more pumps 30 from an external fuel source, such as a tanker truck on the site. On the trailer 22, the one or more pumps 30 are fluidly connected via a fuel line 32 with one or more high precision registers 34 for metering fuel. The fuel line 32 may include, but is not limited to, hard piping. In this example, the fuel line 32 includes a filtration and air eliminator system 36*a* and one or more sensors 36*b*. Although optional, the system 36*a* is beneficial in many implementations, to remove foreign particles and air from the fuel prior to delivery to the equipment. The one or more sensors 36*b* may include a temperature sensor, a pressure sensor, other type of sensor, or a combination thereof, which assist in fuel distribution management.

The fuel line 32 is connected with one or more manifolds 38. In the illustrated example, the station 20 includes two manifolds 38, represented at 38*a* and 38*b*, that are arranged on opposed sides of the compartment 24. As an example, the manifolds 38 are elongated tubes that are generally larger in diameter than the fuel line 32 and that have at least one inlet and multiple outlets. Each hose 40 is wound, at least initially, on a reel 42 that is rotatable to extend or retract the hose 40 externally through one or more windows of the trailer 22. Each reel 42 may have an associated motor to mechanically extend and retract the hose 40.

Figure 3:
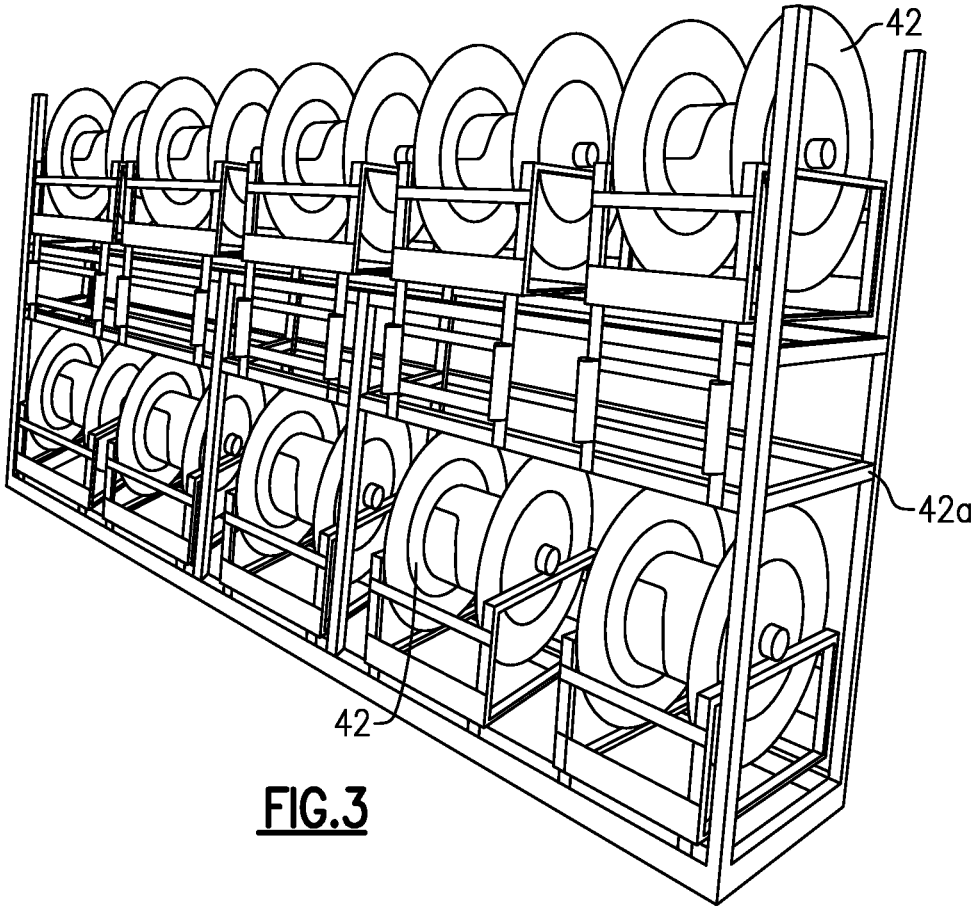
FIG. 3 illustrates an isolated view of hose reels on a support rack used in a mobile distribution station.

As shown in an isolated view in FIG. 3, the reels 42 are mounted on a support rack 42*a*. In this example, the support rack 42*a* is configured with upper and lower rows of reels 42. Each row has five reels 42 such that each support rack 42*a* provides ten reels 42 and thus ten hoses 40. There are two support racks 42*a* (FIG. 2) arranged on opposed sides of the first compartment 24, with an aisle (A) that runs between the support racks 42*a* from an outside door E to the inside door 28*b*. The station 20 therefore provides twenty hoses 40 in the illustrated arrangement, with ten hoses 40 provided on each side of the station 20. As will be appreciated, fewer or additional reels and hoses may be used in alternative examples.

Figure 4:
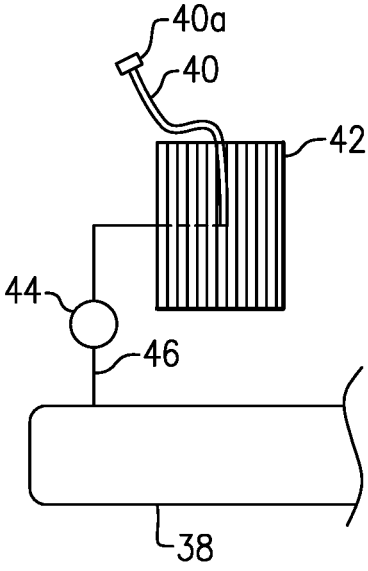
FIG. 4 illustrates an example of a connection between a manifold, a control valve, and a reel.

As shown in a representative example in FIG. 4, each hose 40 is connected to a respective one of the reels 42 and a respective one of a plurality of control valves 44. For example, a secondary fuel line 46 leads from the manifold 38 to the reel 42 and forms a fluid passage from the manifold 38 to the hose 40. If no reels 42 are used, or if fluid is not routed through the reels 42, the hoses 40 may be connected to the secondary fuel lines 46 using a quick connector or the like.

The control valve 44 is in the secondary fuel line 46. The control valve 44 is moveable between open and closed positions, which may also include intermediate positions, to selectively permit fuel flow from the manifold 38 to the reel 42 and the hose 40. Example control valves 44 may include automated valves, such as electric valves or a pneumatic valves. Electric valves convert electrical energy into mechanical motion to open and close a valve element. Pneumatic valves convert compressed gas energy (typically air) into mechanical motion to open and close a valve element. The operation, and thus control, of electrical and pneumatic valves are thus very different. Optionally, a manual valve can also be located near the control valve 44, to enable manual shut-off in the event of power loss or malfunction.

At least the control valves 44, pump or pumps 30, sensor or sensors 36*b*, and register 34 are in communication with a controller 52 located in the second compartment 26. As an example, the controller 52 includes software, hardware, or both that is configured to carry out any of the functions described herein. In one further example, the controller 52 includes a programmable logic controller with a touch-screen for user input and display of status data. For example, the screen may simultaneously show multiple fluid levels of the equipment that is being serviced.

In the illustrated example, the first compartment 24 also includes a sensor support rack 48. The sensor support rack 48 holds integrated fuel cap sensors 50 (when not in use), or at least portions thereof. Each fuel cap sensor 50 may have a bayonet-type connector for locking the cap 50 on the fuel tank of a piece of equipment. When in use, each integrated fuel cap sensor 50 is temporarily affixed to a piece of equipment (i.e., the fuel tank of the equipment) that is subject to the hot-refueling operation. Each hose 40 may include a connector end 40*a* and each integrated fuel cap sensor 50 may have a corresponding mating connector to facilitate rapid connection and disconnection of the hose 40 with the integrated fuel cap sensor 50. For example, the connector end 40*a* and mating connector on the integrated fuel cap sensor 50 form a hydraulic quick-connect.

Figure 5:
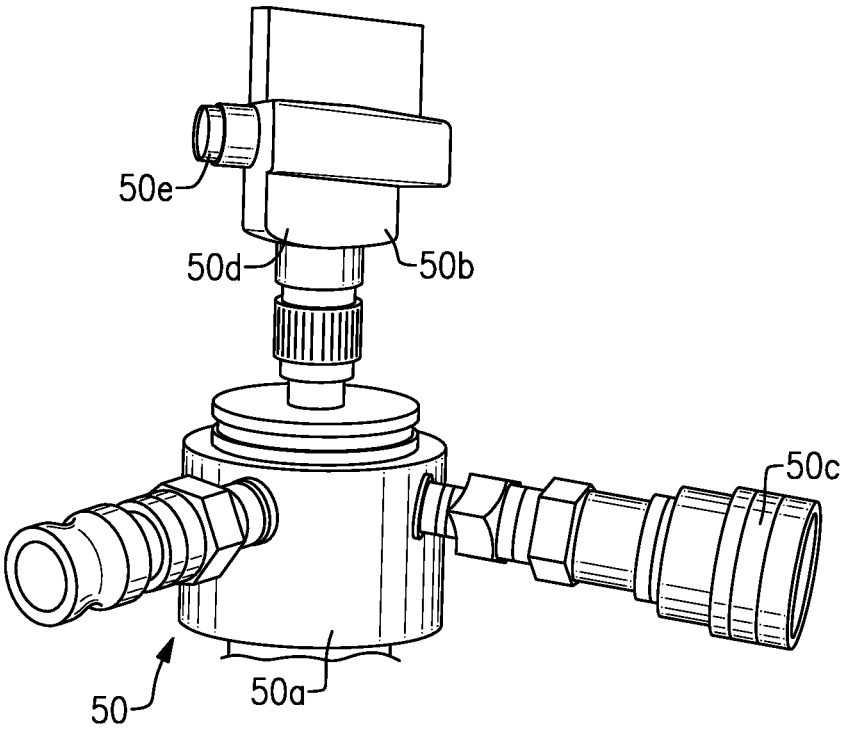
FIG. 5 illustrates an example of an integrated fuel cap sensor.

FIG. 5 illustrates selected portions of a representative example of one of the integrated fuel cap sensors 50. The integrated fuel cap sensor 50 includes a cap portion 50*a* and a fluid level sensor portion 50*b*. The cap portion 50*a* is detachably connectable with a port of a fuel tank. The cap portion 50*a* includes a connector port 50*c*, which is detachably connectable with the connector end 40*a* of the hose 40. The sensor portion 50*b* includes a sensor 50*d* and a sensor port 50*e* that is detachably connectable with a communication line that connects back to the controller 52. The sensor 50*d* may be any type of sensor that is capable of detecting fluid or fuel level in a tank. In one example, the sensor 50*d* is a guided wave radar sensor. A user may first mount the cap portion 50*a* on the fuel tank of the equipment, followed by connecting the hose 40 to the port 50*c* and connecting the communication line to the port 50*e*. As will be appreciated, rather than being integrated, the fuel cap sensors 50 may be non-integrated such that there are separate fuel caps and sensors. The sensors may be separately mounted in sensor ports of the fuel tanks.

The integrated fuel cap sensors 50 may be hard-wired to the controller 52. The term "hard-wired" or variations thereof refers to a wired connection between two components that serves for electronic communication there between, which here is a sensor and a controller.

When in operation, the integrated fuel cap sensors 50 are mounted on respective fuel tanks of the pieces of equipment that are subject to the hot-refueling operation. Each sensor 50*d* generates signals that are indicative of the fuel level in the fuel tank of the piece of equipment on which the integrated fuel cap sensor 50 is mounted. The signals are communicated to the controller 52. The controller 52 interprets the signals and determines the fuel level for each fuel tank of each piece of equipment. In response to a fuel level that falls below a lower threshold, the controller 52 opens the control valve 44 associated with the hose 40 to that fuel tank and activates the pump or pumps 30 if not already active from fueling another piece of equipment. The pump or pumps 30 provide fuel flow into the manifolds 38 and through the open control valve 44 and reel 42 such that fuel is provided through the respective hose 40 and integrated fuel cap sensor 50 into the fuel tank. The lower threshold may correspond to an empty fuel level of the fuel tank, but more typically the lower threshold will be a level above the empty level to reduce the potential that the equipment completely runs out of fuel and shuts down.

The controller 52 determines when the fuel level in the fuel tank reaches an upper threshold. The upper threshold may correspond to a full fuel level of the fuel tank, but more typically the upper threshold will be a level below the full level to reduce the potential for overflow. In response to reaching the upper threshold, the controller 52 closes the respective control valve 44 and ceases the pump or pumps 30. In the event that the control valve 44 malfunctions or is unable to close, the above-mentioned manual valve may be used to stop flow. If other control valves 44 are open or are to be opened, the pump or pumps 30 may remain on. The controller 52 can also be programmed with an electronic stop failsafe measure to prevent over-filling. As an example, once an upper threshold is reached on a first tank and the control valve 44 is closed, but the pump 30 is otherwise to remain on to fill other tanks, if the fuel level continues to rise in the first tank, the controller 52 shuts the pump 30 off.

Multiple control valves 44 may be open at one time, to provide fuel to multiple fuel tanks at one time. Alternatively, if there is demand for fuel from two or more fuel tanks, the controller 52 may sequentially open the control valves 44 such that the tanks are refueled sequentially. For instance, upon completion of refueling of one fuel tank, the controller 52 closes the control valve 44 of the hose 40 associated with that tank and then opens the next control valve 44 to begin refueling the next fuel tank. Sequential refueling may facilitate maintaining internal pressure in the manifold and fuel line 32 above a desired or preset pressure threshold to more rapidly deliver fuel. Similarly, the controller 52 may limit the number of control valves 44 that are open at any one instance in order to maintain the internal pressure in the manifold and fuel line 32 above a desired or preset threshold. The controller 52 may perform the functions above while in an automated operating mode. Additionally, the controller 52 may have a manual mode in which a user can control at least some functions through the PLC, such as starting and stopped the pump 30 and opening and closing control valves 44. For example, manual mode may be used at the beginning of a job when initially filling tanks to levels at which the fuel cap sensors 50 can detect fuel and/or during a job if a fuel cap sensor 50 becomes inoperable. Of course, operating in manual mode may deactivate some automated functions, such as filling at the low threshold or stopping at the high threshold.

In addition to the use of the sensor signals to determine fuel level, or even as an alternative to use of the sensor signals, the refueling may be time-based. For instance, the fuel consumption of a given piece of equipment may be known such that the fuel tank reaches the lower threshold at known time intervals. The controller 52 is operable to refuel the fuel tank at the time intervals rather than on the basis of the sensor signals, although sensor signals may also be used to verify fuel level.

The controller 52 also tracks the amount of fuel provided to the fuel tanks. For instance, the register 34 precisely measures the amount of fuel provided from the pump or pumps 30. As an example, the register 34 is an electronic register and has a resolution of about 0.1 gallons. The register 34 communicates measurement data to the controller 52. The controller 52 can thus determine the total amount of fuel used very precisely. The controller 52 may also be configured to provide outputs of the total amount of fuel consumed. For instance, a user may program the controller 52 to provide outputs at desired intervals, such as by worker shifts or daily, weekly, or monthly periods. The outputs may also be used to generate invoices for the amount of fuel used. As an example, the controller 52 may provide a daily output of fuel use and trigger the generation of an invoice that corresponds to the daily fuel use, thereby enabling almost instantaneous invoicing.

Figure 6:
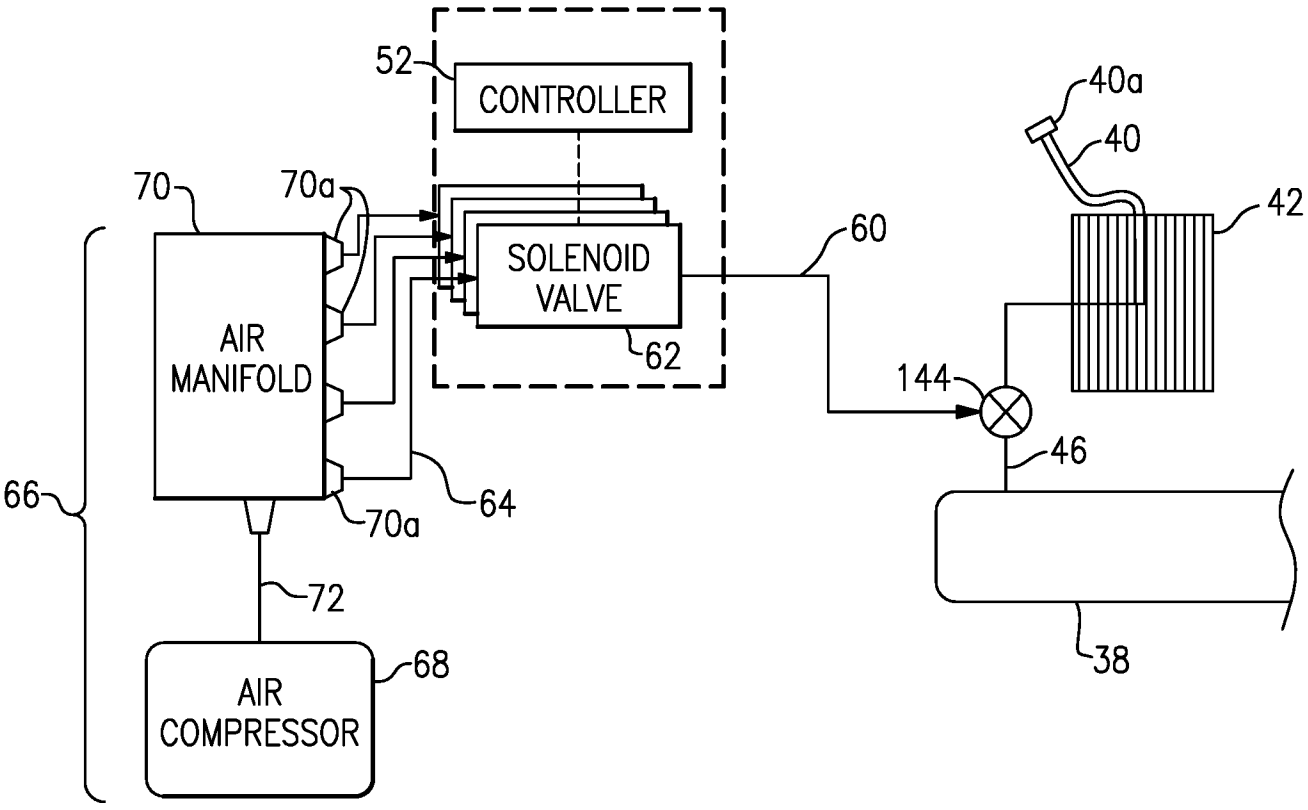
FIG. 6 illustrates selected portion of another example mobile distribution station that has pneumatic valves.

FIG. 6 illustrates selected representative portions of another example mobile distribution station 120. Unless otherwise noted or implied, the station 120 is generally the same as the above-described station 20. In this example, the station 120 utilizes control valves 144 in place of the prior control valves 44. Each control valve 144 is situated in the fuel line 46 between a respective reel 42 and manifold 38. The control valves 144 are not in electrical communication with the controller 52. One representative control valve 144 is shown to demonstrate its arrangement and function, but it is to be understood that there are multiple similar control valves 144 that are likewise arranged.

The control valves 144 are pneumatic valves, such as pneumatic ball valves, that operate by air or gas pressure to open and close, without electric signals being provided to the control valves 144. In this regard, each control valve 144 is connected by an air or gas line 60 to a respective secondary valve 62. For example, the secondary valve 62 is a solenoid valve that is in electrical communication with the controller 52. The secondary valve 62 may be located remotely from the control valve 144 and the fuel line 46 (and from the manifold 38) and, for example, may be located in the first compartment 24 or the second compartment 26. Thus, for each hose 40, there would be a corresponding control valve 144 and a corresponding secondary valve 62. For example, if there are twenty hoses, there would be twenty control valves 144 and twenty secondary valves 62.

Each secondary valve 62 is connected by an air or gas line 64 to a pressurized air or gas source 66. In this example, the air or gas source 66 includes a compressor 68 and a gas manifold 70, however pressurized gas from the well or other sources can also be used. The manifold 70, compressor 68, or both may also be located in the first compartment 24 or the second compartment 26. For example, the manifold 70 is mounted on the wall 28*a* in the second compartment 26 and the compressor 68 is mounted nearby or near the end of the trailer adjacent to end wall E1. The compressor 68 is connected to the manifold 70 by an air or gas line 72. The manifold 70 may have one or more fittings 70*a* that serve as connectors for securing air or gas lines to the valves 62. As an example, the fittings 70*a* may be nipples, quick connects, or the like. The manifold 70 permits a single compressor 68 to be used to distribute pressurized air or gas to the secondary valves 62. As will be appreciated, additional compressors could be used. In one alternative, rather than the manifold 70, or in addition to the manifold 70, a compressor 68 is connected directly to respective secondary valves 62 such that a single compressor 68 serves a single secondary valve 62.

The control valves 144 and secondary valves 62 operate somewhat differently than the single control valves 44 described above. Here, in response to a fuel level that falls below a lower threshold, the controller 52 sends a signal to open the corresponding secondary valve 62 associated with the hose 40 to that fuel tank, activates the compressor 68 (if not already active), and activates the pump or pumps 30. Pressurized air generated in the compressor 68 flows through the line 72, into the manifold 70, through line 64, and then into the secondary valve 62. The opening of the secondary valve 62 permits the air to flow through line 60 into the (pneumatic) control valve 144. The air entering the control valve 144 operates to open a valve element, and the opening of the valve element permits fuel to flow through the line 46 from the manifold 38 to the reel 42 and hose 40. It is to be understood that the (pneumatic) control valve 144 as described is biased to close in the absence of air from the secondary valve 62 (i.e., a "normally closed" pneumatic valve). Alternatively, the (pneumatic) control valve 144 could be oppositely configured, to be biased to the open position such that the air from the secondary valve 62 closes the valve element to stop fuel flow. As will be appreciated, if there is demand from several hoses 40 for fuel, the controller 52 may open several secondary valves 62 to permit air to flow to several control valves 144. Again, since the secondary valves 62 are located remotely from the manifold 38 and line 46, and the control valves 144 do not operate by electricity, there is no exposure between the fuel and electricity.

When the fuel level in the fuel tank reaches the upper threshold, the controller 52 closes the respective secondary valve 62 and may cease the compressor 68 and pump or pumps 30. If other secondary valves 62 are open or are to be opened, the compressor 68 and pump or pumps 30 may remain on.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A distribution station comprising:

a plurality of pneumatic valves on a mobile structure, each said pneumatic valve situated between a manifold and a reel of a plurality of reels;

a plurality of secondary valves, each said secondary valve connected by an air or gas line to a corresponding one of the pneumatic valves, each said secondary valve operable between open and closed positions to permit air or gas flow to the corresponding pneumatic valve to open and close the pneumatic valve; and a controller configured to individually open and close the secondary valves responsive to fluid level sensors, wherein the mobile structure includes first and second compartments separated by a wall, the manifold, the plurality of reels, and the pneumatic valves are located in the first compartment, and the controller and the secondary valves are located in the second compartment.

2. The distribution station as recited in claim 1, wherein the pressurized gas source includes a compressor.

3. The distribution station as recited in claim 2, wherein the pressurized gas source includes a pressurized gas manifold.

4. The distribution station as recited in claim 1, further comprising a pressurized gas source connected to the pneumatic valves, wherein the pressurized gas source is located in the second compartment.

5. A distribution station comprising:

a mobile structure;

a pump;

a manifold connected with the pump;

a plurality of hoses, each said hose being connected by a fluid passage to the manifold;

a plurality of pneumatic valves, each said pneumatic valve situated in a respective one of the fluid passages between the manifold and a respective different one of the hoses and being operable to control fluid flow through the fluid passage;

a plurality of fluid level sensors, each said fluid level sensor being associated with a respective different one of the hoses; and a plurality of secondary valves, each said secondary valve connected by an air or gas line to a corresponding one of the pneumatic valves, each said secondary valve operable between open and closed positions to permit air or gas flow to the corresponding pneumatic valve to open and close the pneumatic valve; and a controller configured to individually open and close the secondary valves responsive to the fluid level sensors, wherein the mobile structure includes first and second compartments separated by a wall, the manifold and the pneumatic valves are located in the first compartment, and the controller and the secondary valves are located in the second compartment.

6. The distribution station as recited in claim 5, further comprising a pressurized gas source connected to the pneumatic valves.

7. The distribution station as recited in claim 6, wherein the pressurized gas source includes a compressor.

8. The distribution station as recited in claim 7, wherein the pressurized gas source includes a pressurized gas manifold.

9. The distribution station as recited in claim 5, further comprising a pressurized gas source connected to the pneumatic valves, wherein the pressurized gas source is located in the second compartment.

* * * * *